US012366148B2

(12) United States Patent
Fehri

(10) Patent No.: US 12,366,148 B2
(45) Date of Patent: Jul. 22, 2025

(54) SYSTEM AND METHOD FOR DEPLOYING ESP ON COILED TUBING

(71) Applicant: Baker Hughes Oilfield Operations LLC, Houston, TX (US)

(72) Inventor: Ahmed Fehri, Tunis (TN)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/242,292

(22) Filed: Sep. 5, 2023

(65) Prior Publication Data

US 2024/0076944 A1 Mar. 7, 2024

Related U.S. Application Data

(60) Provisional application No. 63/404,289, filed on Sep. 7, 2022.

(51) Int. Cl.
*E21B 43/12* (2006.01)
*E21B 19/22* (2006.01)
*E21B 33/06* (2006.01)

(52) U.S. Cl.
CPC ..... *E21B 43/128* (2013.01); *E21B 19/22* (2013.01); *E21B 33/06* (2013.01)

(58) Field of Classification Search
CPC ..... E21B 43/128; E21B 19/22; E21B 33/06
See application file for complete search history.

(56) References Cited

U.S. PATENT DOCUMENTS 3,853,430 A 12/1974 Grumman
4,440,221 A 4/1984 Taylor et al.
4,773,489 A 9/1988 Makohl
5,145,007 A 9/1992 Dinkins
5,145,592 A 9/1992 Caporiccio
6,155,792 A * 12/2000 Hartley ..... F04B 47/06 417/415
6,352,113 B1 * 3/2002 Neuroth ..... E21B 43/128 166/301
9,074,592 B2 7/2015 Morrison et al.
9,255,457 B2 2/2016 Scarsdale et al.
(Continued)

OTHER PUBLICATIONS

"International Search Report and Written Opinion for PCT/US2023/31987 mailed Feb. 1, 2024".

*Primary Examiner* — D. Andrews
(74) *Attorney, Agent, or Firm* — Baker Hughes Company

(57) ABSTRACT

Systems and methods for installing a coiled tubing pumping system in a well permit the use of a standard wellhead. A method for installing the coiled tubing pumping system includes the steps of connecting a continuous length of coiled tubing to the coiled tubing pumping system, lowering the coiled tubing pumping system and coiled tubing into the production tubing, and temporarily supporting the weight of the coiled tubing pumping system with an installation kit. The method continues with the steps of cutting the continuous length of coiled tubing to form a coiled tubing segment attached to the coiled tubing pumping system, attaching a deployment assembly to an upper end of the coiled tubing segment connected to the coiled tubing pumping system, and lowering the deployment assembly, the coiled tubing segment and the coiled tubing pumping system into the well until the deployment assembly lands on the seating element.

13 Claims, 17 Drawing Sheets

(56) References Cited

U.S. PATENT DOCUMENTS

| | | | | |
|---|---|---|---|---|
| 10,253,606 | B1 | 4/2019 | Artinian et al. | |
| 10,605,011 | B2 * | 3/2020 | Cochran | E21B 19/084 |
| 10,774,608 | B2 * | 9/2020 | June | E21B 33/03 |
| 11,085,260 | B2 | 8/2021 | Aladawy et al. | |
| 2010/0089588 | A1 | 4/2010 | Thompson | |
| 2010/0288501 | A1 | 11/2010 | Fielder et al. | |
| 2011/0000683 | A1 | 1/2011 | Denoix et al. | |
| 2011/0240312 | A1 | 10/2011 | Varkey et al. | |
| 2011/0247828 | A1 * | 10/2011 | Patel | E21B 33/076 166/348 |
| 2011/0300008 | A1 | 12/2011 | Fielder et al. | |
| 2012/0024543 | A1 | 2/2012 | Head | |
| 2013/0277042 | A1 | 10/2013 | Scarsdale et al. | |
| 2016/0003016 | A1 | 1/2016 | Chang et al. | |
| 2016/0194939 | A1 | 7/2016 | Lastra et al. | |
| 2018/0283384 | A1 | 10/2018 | Aladawy et al. | |
| 2018/0320454 | A1 | 11/2018 | Cochran | |
| 2019/0017357 | A1 | 1/2019 | Head et al. | |
| 2020/0095852 | A1 | 3/2020 | Lastra et al. | |
| 2021/0140247 | A1 * | 5/2021 | Bishop | E21B 17/028 |

* cited by examiner

SYSTEM AND METHOD FOR DEPLOYING ESP ON COILED TUBING

RELATED APPLICATIONS

The present application claims the benefit of U.S. Provisional Patent Application Ser. No. 63/404,289 filed Sep. 7, 2022 and entitled "System and Method for Deploying ESP on Coiled Tubing," the disclosure of which is incorporated by reference as if fully set forth herein.

FIELD OF THE INVENTION

This invention relates generally to the production of hydrocarbons from a subterranean formation using an electric submersible pumping system, and more particularly, but not by way of limitation, to systems and methods for deploying an electric submersible pumping system within the wellbore.

BACKGROUND

Submersible pumping systems are often deployed into wells to recover petroleum fluids from subterranean reservoirs. Typically, the submersible pumping system includes a number of components, including one or more electric motors coupled to one or more pumps. Each of the components and sub-components in a submersible pumping system is engineered to withstand the inhospitable downhole environment, which includes wide ranges of temperature, pressure and corrosive well fluids.

Conventional electric submersible pumping systems are connected to surface facilities and equipment through interconnected joints of rigid production tubing. The pumping system and tubing are often run inside a cased wellbore and the production fluids are pumped to the surface through the production tubing. The deployment and extraction of the pumping system are complicated, costly and time intensive endeavors because the downhole assembly is typically secured to a lower joint of the production tubing, which requires the operator to assemble or disassemble the joints above the electric submersible pumping system with a large workover rig. Workover rigs are often expensive and difficult to source.

As an alternative to the use of rigid production tubing, pump manufacturers have designed systems in which an electric submersible pumping system is installed within the wellbore using coiled tubing systems. One such example is the TransCoil brand rigless-deployed coiled tubing system developed by Baker Hughes Company. In these systems, the coiled tubing can be used to provide electrical power and support the weight of the electric submersible pumping system. The electric submersible pumping system can be configured to pump fluids to the surface through the annular space between the coiled tubing and the surrounding well casing. In some cases, the use of a coiled tubing deployment system can reduce the installation time of the electric submersible pumping system by more than 50%.

Although these systems have achieved some commercial success, there remains a need for improved systems and methods for deploying an electric submersible pumping system using coiled tubing. In particular, existing coiled tubing deployment systems require a specialized wellhead to install, suspend and retrieve the coiled tubing-deployed electric submersible pumping system. It is to this and other deficiencies in the prior art that embodiments of the present disclosure are directed.

SUMMARY OF THE INVENTION

In some embodiments, the present disclosure is directed to a deployment assembly for installing a coiled tubing pumping system in a well that includes production tubing and a seating element connected inside the production tubing, where the coiled tubing pumping system is connected to a length of coiled tubing that includes an internal power cable. In these embodiments, the deployment assembly includes a hanger assembly, an adapter assembly, and a lifting assembly. The hanger assembly is configured to transfer the weight of the coiled tubing pumping system to the production tubing through the seating element.

In other embodiments, the present disclosure is directed to a method for installing a coiled tubing pumping system in a well that includes production tubing and a seating element connected to the production tubing. The method includes the steps of connecting a continuous length of coiled tubing to the coiled tubing pumping system, lowering the coiled tubing pumping system and coiled tubing into the production tubing, and temporarily supporting the weight of the coiled tubing pumping system. The method continues with the steps of cutting the continuous length of coiled tubing to form a coiled tubing segment attached to the coiled tubing pumping system, attaching a deployment assembly to an upper end of the coiled tubing segment connected to the coiled tubing pumping system, and lowering the deployment assembly, the coiled tubing segment and the coiled tubing pumping system into the well until the deployment assembly lands on the seating element.

In yet other embodiments, the present disclosure is directed to an installation kit for facilitating the assembly of a deployment assembly used for the installation or retrieval of a coiled tubing pumping system attached to a length of coiled tubing within a well. The installation kit includes a support table configured to be located on the top of a BOP that is temporarily installed on the well, an installation hanger on the support table, one or more installation slips that secure the coiled tubing within the installation hanger, and a deployment assembly table configured to support the deployment assembly. The installation slips transfer the weight of the coiled tubing pumping system to the support table through the installation hanger.

WRITTEN DESCRIPTION

Figure 1:
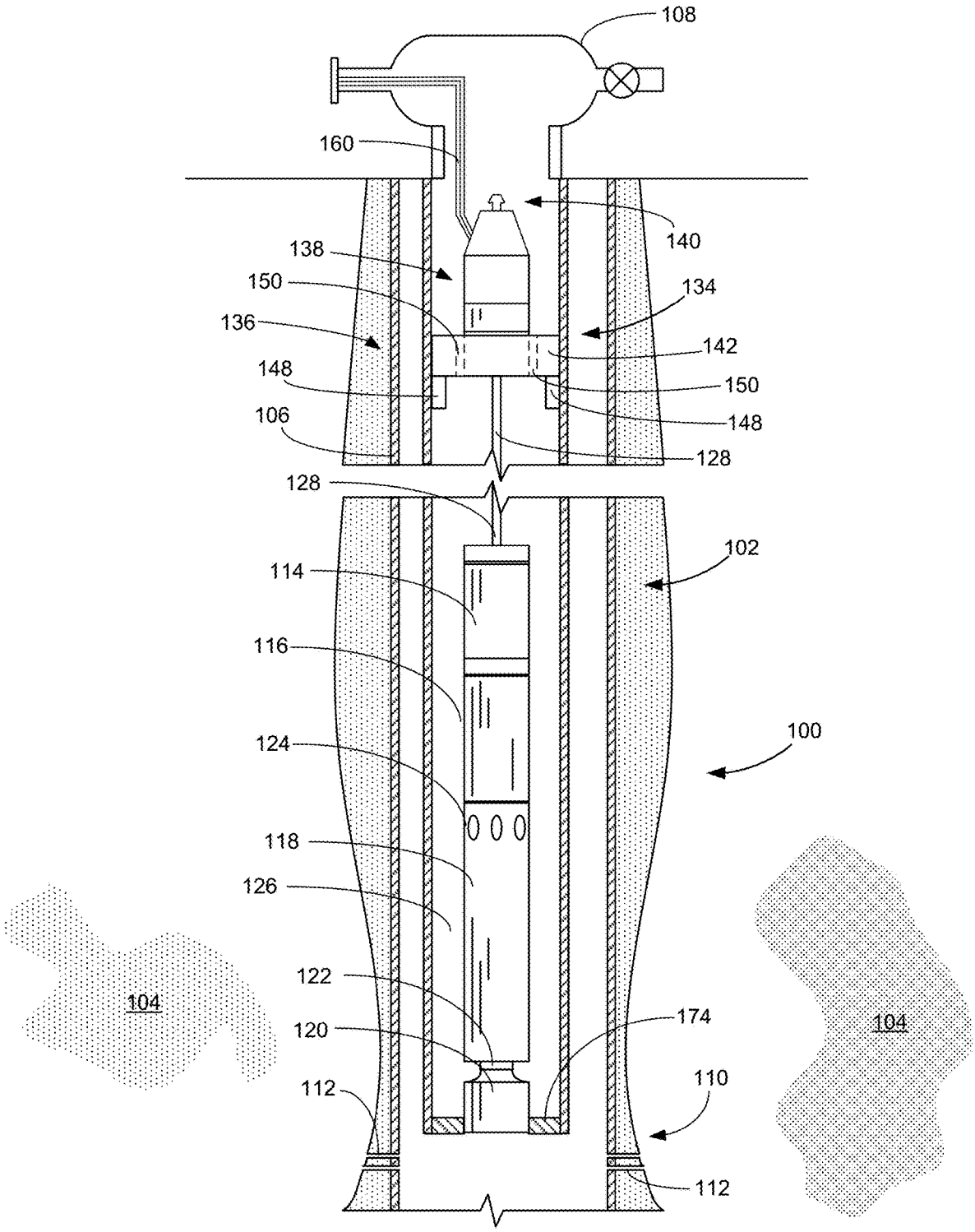
FIG. 1 depicts a coiled tubing pumping system constructed and installed in accordance with exemplary embodiments.

In accordance with exemplary embodiments of the present invention, FIG. 1 shows an elevational view of a first embodiment of a coiled tubing pumping system 100 installed in a well 102 within a reservoir 104. The well 102 includes production tubing 106, a wellhead 108 and a lower completion 110. The coiled tubing pumping system 100 is deployed in the production tubing 106 and connected to the lower completion 110, which provides a path for reservoir fluids to the coiled tubing pumping system 100 through perforations 112. The production tubing 106 is installed in the well 102 before the installation of the coiled tubing pumping system 100. The production tubing 106 is often part of the permanent completion, which may also include a well casing, as depicted in FIG. 1.

The coiled tubing pumping system 100 includes a motor 114, a seal section 116, a pump 118 and a seal stack 120. The coiled tubing pumping system 100 is configured in an "inverted" orientation in which the pump 118 is positioned below the motor 114. The pump 118 includes a lower intake 122 connected to the seal stack 120, which is in turn in fluid communication with the lower completion 110. The seal stack 120 also creates a sealed interface between the lower intake 122 and the discharge 124 to avoid fluid recirculation. The seal stack 120 is configured to translate freely inside the seal bore receptacle 174 in the production tubing 106.

The pump 118 includes an upper discharge 124 that is configured to produce fluids through the annular space 126 between the coiled tubing pumping system 100 and the production tubing 106, where the fluids can be recovered through the wellhead 108. Although the coiled tubing pumping system 100 is well-suited for pumping petroleum fluids from the reservoir 104, it will be appreciated that the coiled tubing pumping system 100 can also be configured to produce fresh water, brine, or other fluids from the reservoir 104. Additionally, it will be appreciated that the reservoir 104 and well 102 can be located onshore or offshore.

The coiled tubing pumping system 100 is connected to a length of coiled tubing 128, which includes an outer structural casing 130 and an interior power cable 132. The coiled tubing 128 extends between the coiled tubing pumping system 100 and a deployment assembly 134, which is connected to and supported by the production tubing 106 between the wellhead 108 and the coiled tubing pumping system 100. In some embodiments, the weight of the coiled tubing pumping system 100 is supported entirely or partially by the coiled tubing 128 and deployment assembly during installation, retrieval and operation of the coiled tubing pumping system 100. In other embodiments, the seal stack 120 supports at least a portion of the weight of the coiled tubing pumping system 100 while the coiled tubing pumping system 100 is installed in the well 102.

Figure 2:
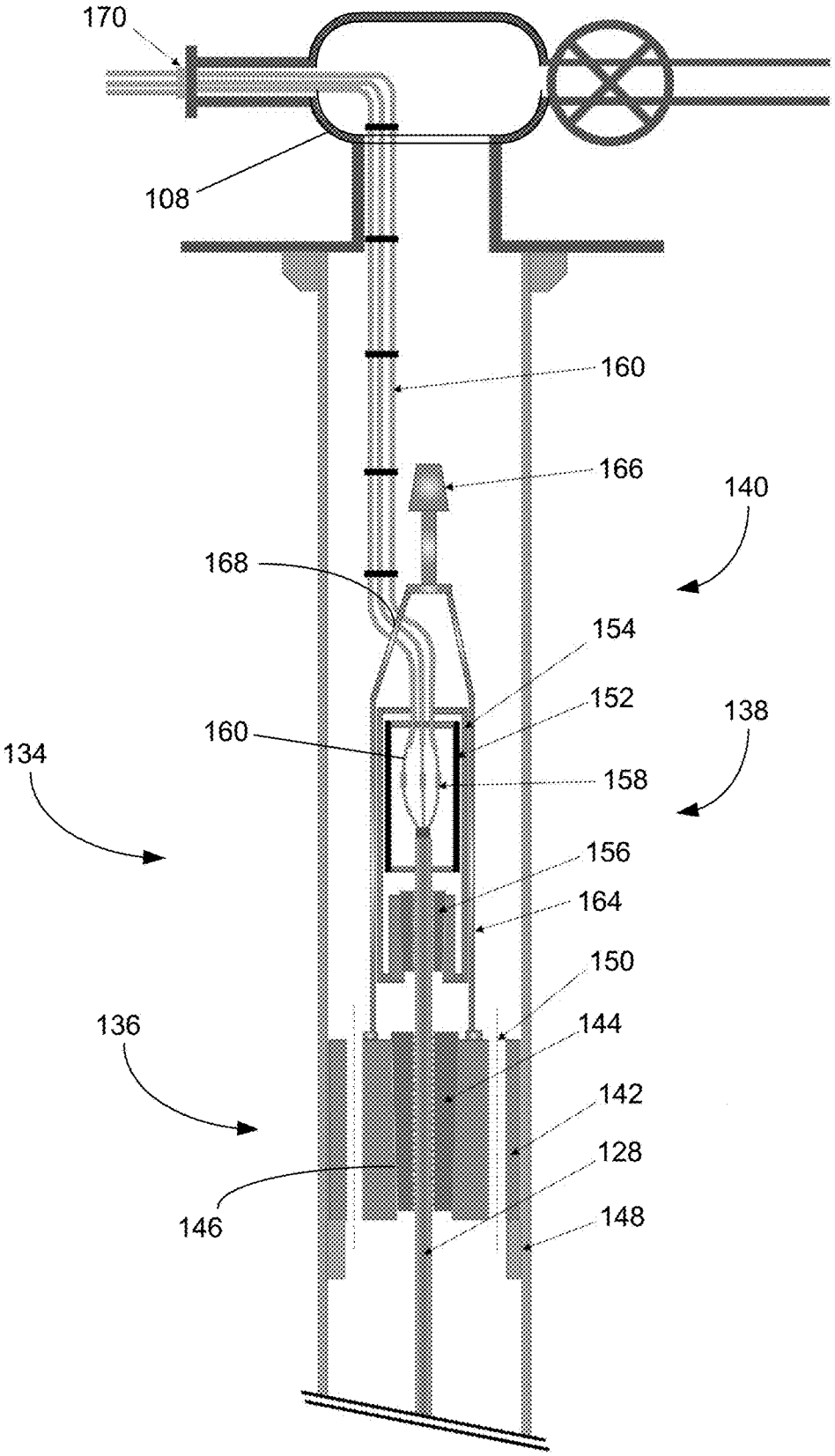
FIG. 2 depicts a first embodiment of the deployment assembly of the coiled tubing pumping system of FIG. 1.
Figure 3:
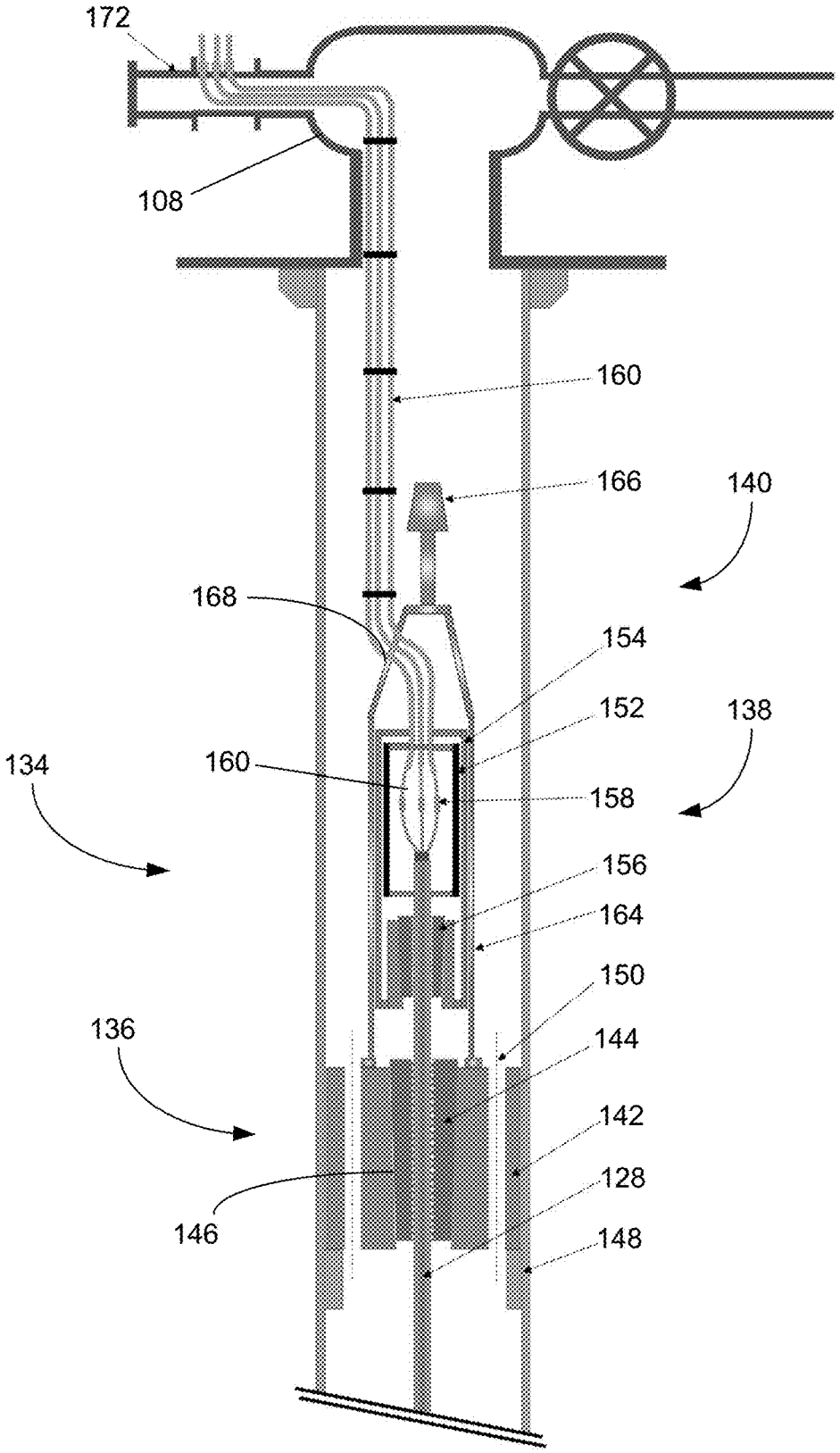
FIG. 3 depicts a second embodiment of the deployment assembly of the coiled tubing pumping system of FIG. 1.

Turning to FIGS. 2 and 3, shown therein are depictions of the deployment assembly 134 within the production tubing 106. The deployment assembly 134 is generally configured to support the coiled tubing pumping system 100 within the well 102 without the need for a specialized or modified wellhead. The deployment assembly 134 includes a primary hanger assembly 136, an adapter assembly 138 and a lifting assembly 140. The primary hanger assembly 136 includes a primary hanger 142 and primary slips 144. The primary slips 144 are configured to compressively grip the coiled tubing 128 with an interference fit inside the primary hanger 142.

The primary hanger 142 includes a tapered central portion 146 that mates with a conical outer surface of the primary slips 144. In this way, the weight of the coiled tubing pumping system 100 pulls the primary slips 144 downward into further engagement with the primary hanger 142, which increases the grip between the primary slips 144 and the coiled tubing 128 such that the weight of the coiled tubing pumping system 100 is transferred through the primary slips 144 to the primary hanger 142. The primary hanger 142, in turn, transfers the weight of the coiled tubing pumping system 100 to the production tubing 106 through a seating element 148 connected to the production tubing 106. The seating element 148 can be a seating nipple, mandrel or other annular component that provides a landing surface for the primary hanger 142. The seating element 148 can be positioned close to the surface. The primary hanger 142 also includes one or more production ports 150 that provide a path for pumped fluids to pass through the primary hanger 142 within the annular space 126.

The adapter assembly 138 includes a connection chamber 152, an adapter support 154 and adapter slips 156. The connection chamber 152 (shown in cross section) provides a secure, sealed housing for the electrical connection between power cable leads 158 and corresponding encapsulated surface leads 160, which provide power and control signals from a motor drive (not shown). In some embodiments, the connection chamber 152 further includes a pressure compensation element 162 to accommodate changes in pressure surrounding the adapter assembly 138. The pressure compensation element 162 can include bellows, bags, pistons or other pressure compensation mechanisms. Although components of the adapter assembly 138 are depicted in cross-section in FIGS. 2 and 3, it will be appreciated that the connection chamber 152 is a sealed component that prevents the ingress of fluids into the coiled tubing 128 and the encapsulated surface leads 160.

The adapter support 154 transfers the weight of the adapter assembly 138 to the upper end of the coiled tubing 128 through the adapter slips 156. The adapter support 154 can be configured for connection to the adapter slips 156 such that the weight of the adapter assembly 138 presses the adapter slips 156 into a tight engagement with the coiled tubing 128 within the adapter support 154. In other embodiments, the adapter assembly 138 is connected to the adapter support 154, which transfers the weight of the adapter assembly 138 to the coiled tubing through the adapter slips 156.

The lifting assembly 140 includes a lift body 164 secured to the primary hanger 142. The lift body 164 includes a fishing head 166 and a cable port 168. The fishing head 166 is configured for connection to a lifting or fishing tool (not shown in FIG. 2). The cable port 168 provides a sealed passage for the encapsulated surface leads 160.

Thus, the deployment assembly 134 provides a system for supporting the weight of the coiled tubing pumping system 100 through a connection to the production tubing 106, rather than the use of a specialized or modified wellhead. In FIG. 2, the wellhead 108 includes a blanked flange 170 through which the encapsulated surface leads 160 are routed. In FIG. 3, the wellhead 108 includes a surface penetrator 172 that permits the routing of the encapsulated surface leads 160. During use, the motor 114 receives electrical power through the power cable 132 and encapsulated surface leads 160. When energized, the motor 114 drives the pump 118, which pushes fluid from the reservoir 104 to the wellhead 108 through the annular space 126. The pumped fluids pass through the production ports 150 within the primary hanger 142.

Figure 4:
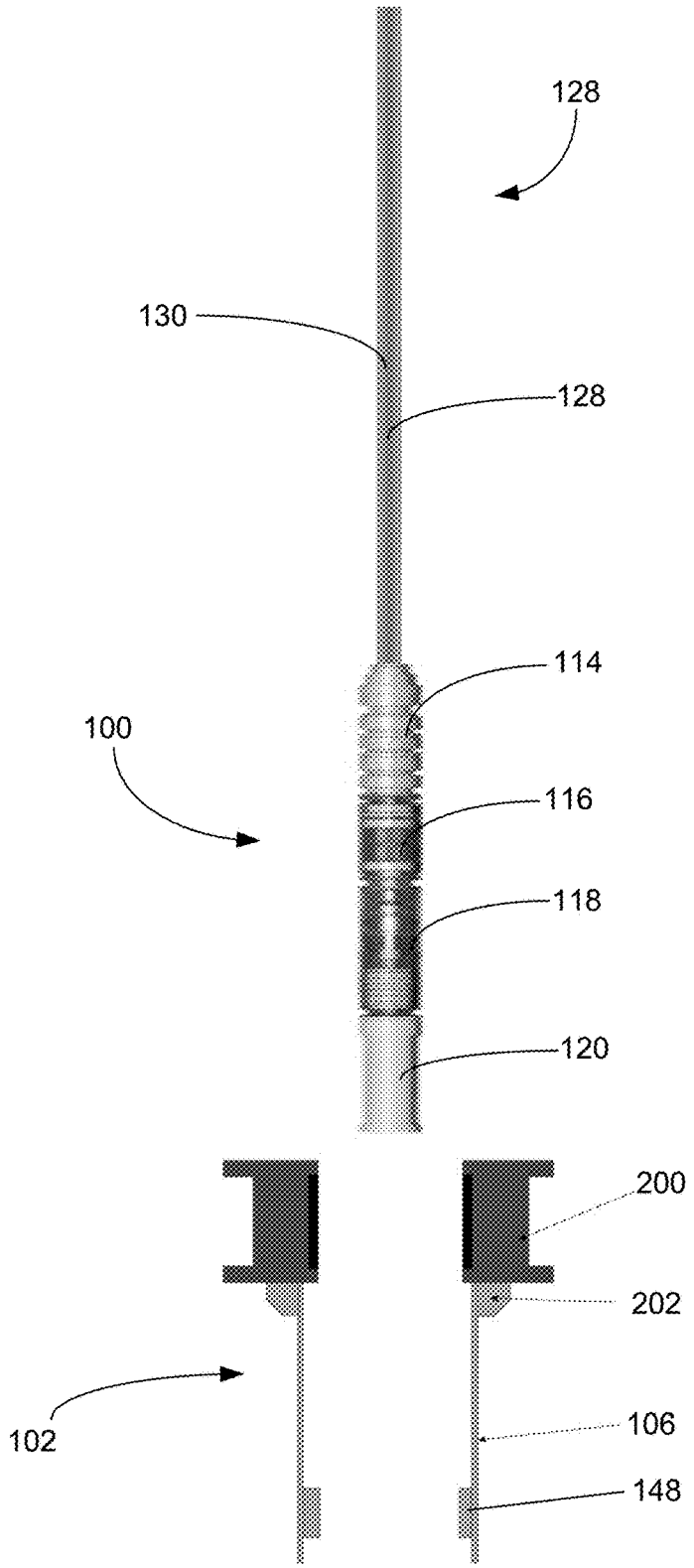
FIG. 4 depicts a step in the installation of the coiled tubing pumping system in which the coiled tubing pumping system is lowered into the well through a blowout prevent (BOP).

Turning to FIGS. 4-17, shown therein are graphical depictions of methods for installing the coiled tubing pumping system 100 in the well 102 using the deployment assembly 134. Prior to starting the deployment of the coiled tubing pumping system 100 in the well 102, the production tubing 106 is installed in the well 102 with the seating element 148 and the seal bore receptacle 174 (step not shown). In a first step depicted in FIG. 4, a blowout preventer (BOP) 200 is installed on top of the well 102. The BOP 200 can be connected to a conventional tubing hanger 202 that connects the production tubing 106 to surface facilities. A lifting device (not shown) such as a coiled tubing injector, powered reel or crane lowers the coiled tubing pumping system 100 into the well 102 through the BOP 200.

Figure 5:
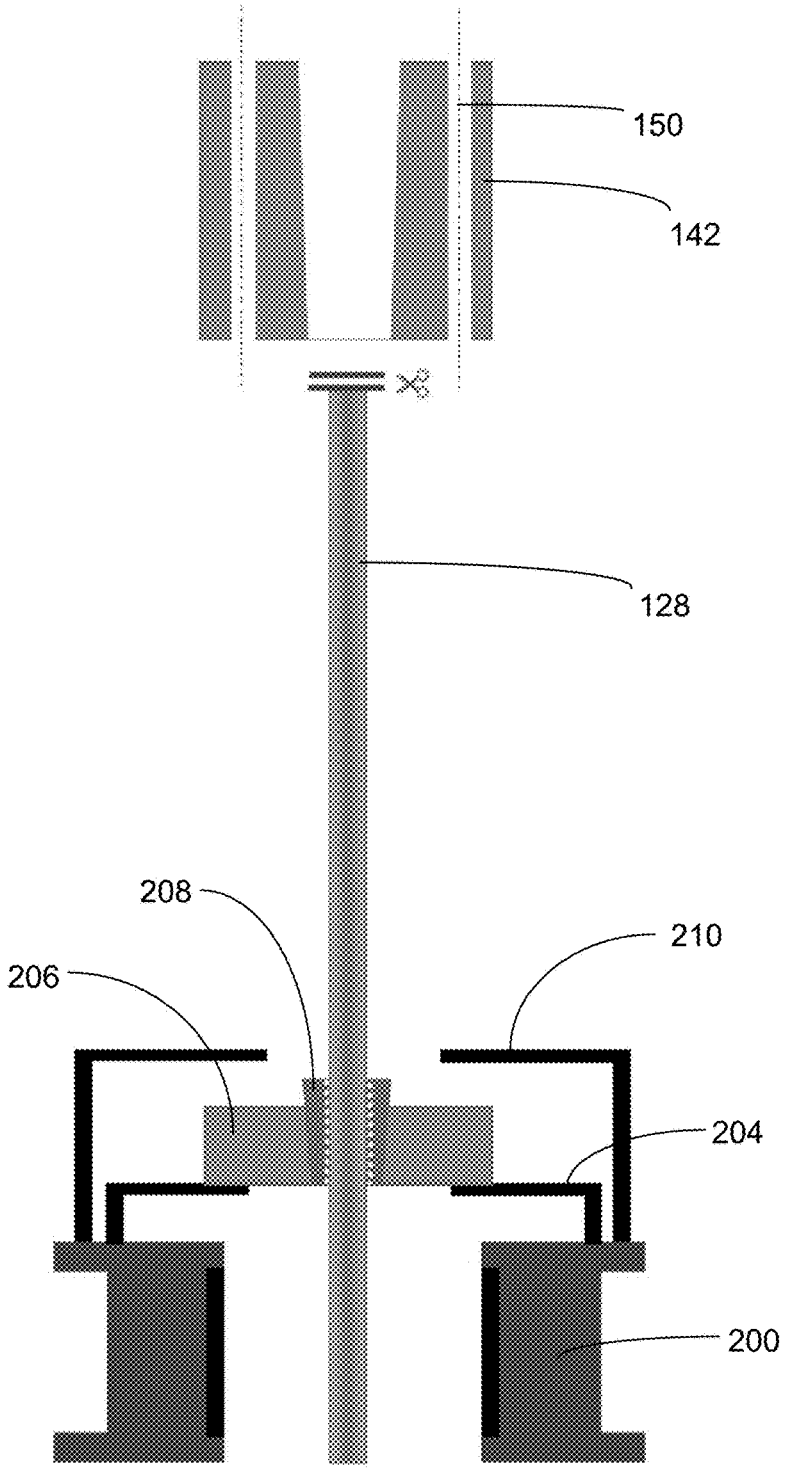
FIG. 5 depicts a step in the installation of the coiled tubing pumping system in which the coiled tubing pumping system is supported by a support table on the BOP and the coiled tubing is cut in preparation for connection to the deployment assembly.

When the coiled tubing pumping system 100 has reached or is nearing its operational depth, for example when the seal stack 120 approaches the lower completion 110, a support table 204 is placed on the top of the BOP 200, as illustrated in FIG. 5. An installation hanger 206 is placed on the support table 204 and installation slips 208 are used to secure the coiled tubing 128 within the support table 204. When the weight of the coiled tubing pumping system 100 is supported by the installation slips 208 and installation hanger 206, the coiled tubing 128 can be cut at an upper end of the coiled tubing 128.

Figure 6:
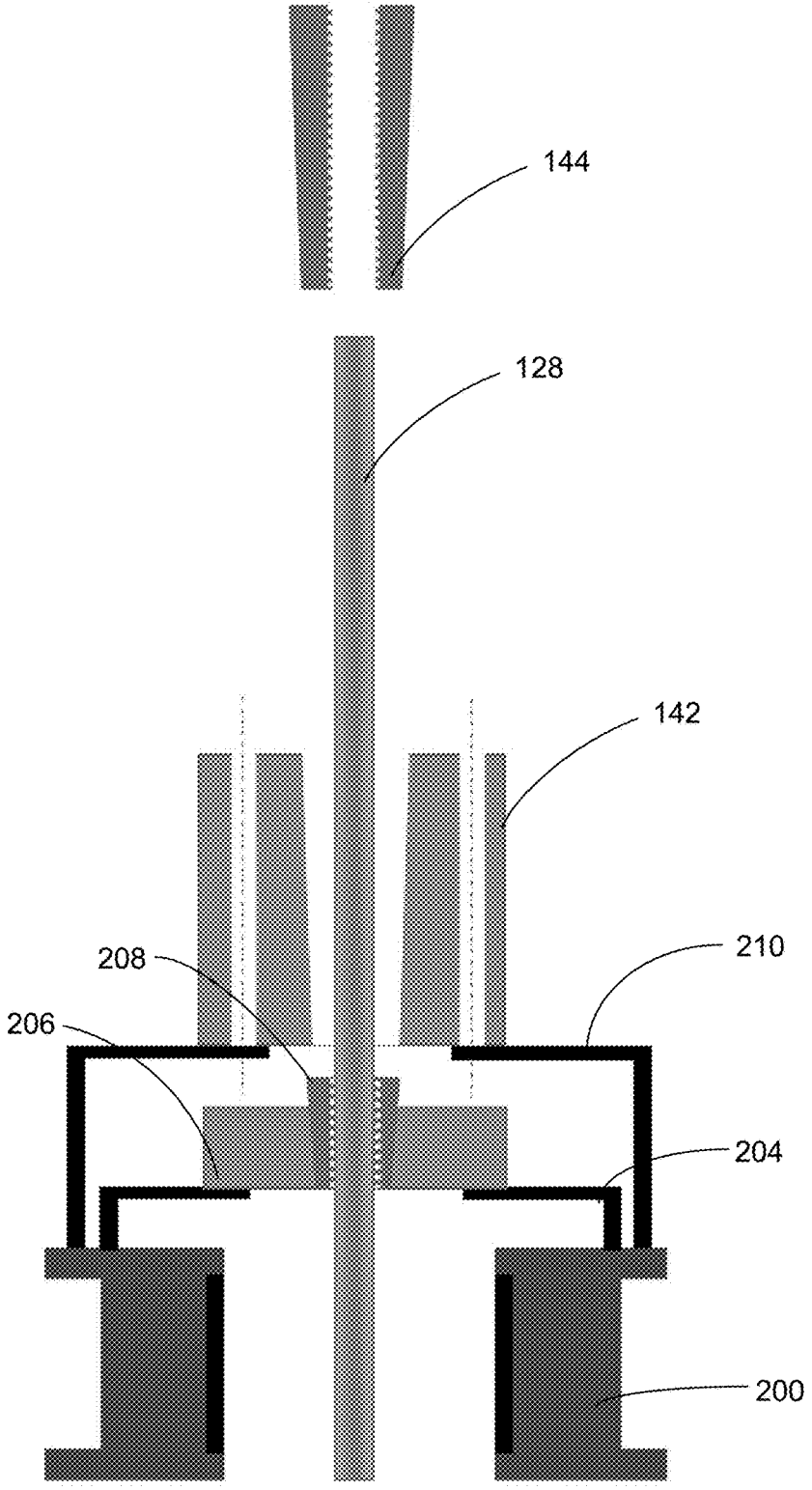
FIG. 6 depicts a step in the installation of the coiled tubing pumping system in which the deployment assembly is supported by the assembly table on the BOP.
Figure 7:
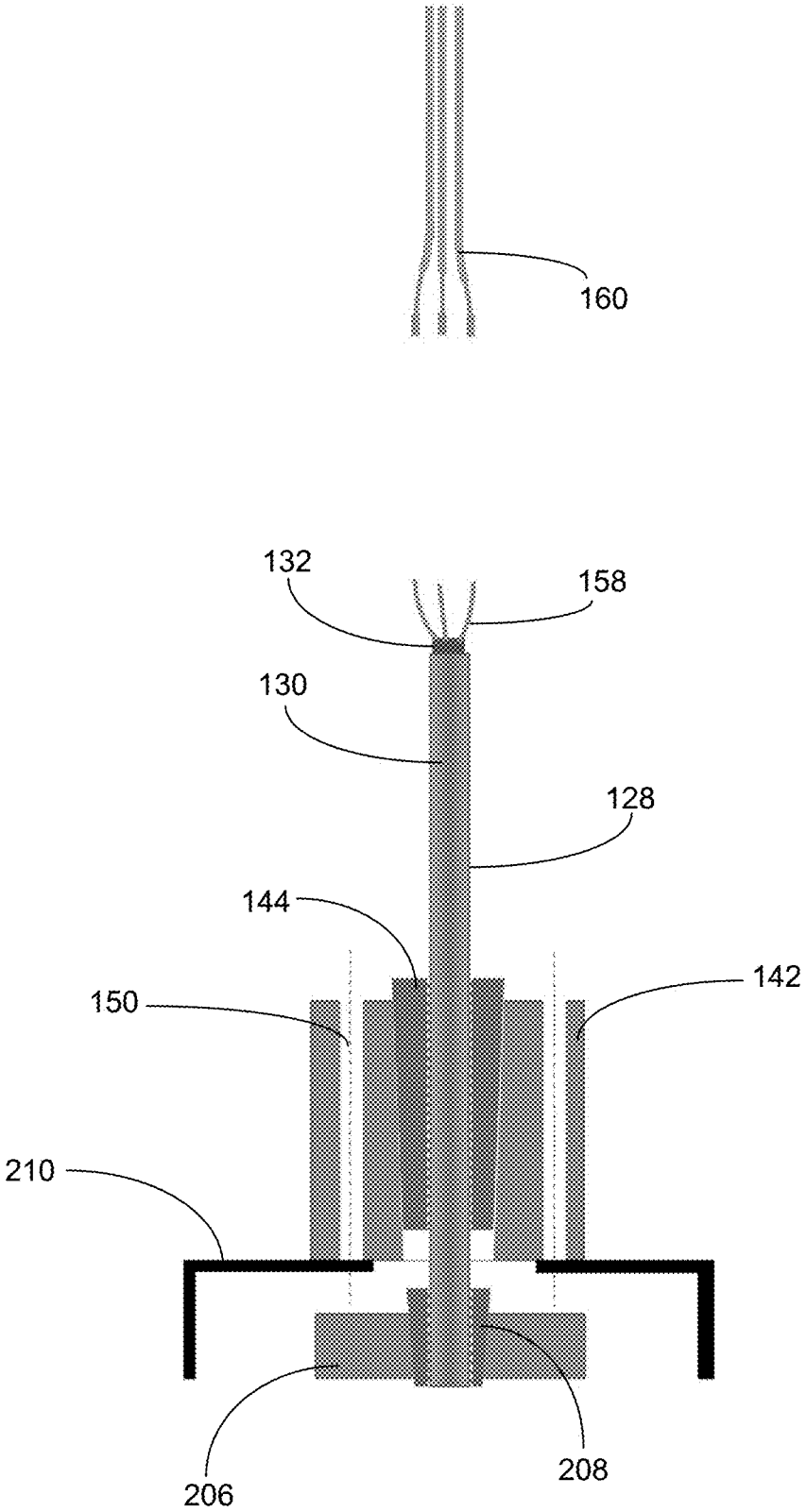
FIG. 7 depicts a step in the installation of the coiled tubing pumping system in which the coiled tubing is prepared for a spliced connection to the power cable.

As illustrated in FIG. 5, a deployment assembly table 210 is also placed on the top of the BOP 200. The primary hanger 142 can then be placed over the cut end of the coiled tubing 128 and lowered onto the deployment assembly table 210, as illustrated in FIG. 6. The primary slips 144 are then installed around the coiled tubing 128 and pressed into place within the tapered central portion 146 of the primary hanger 142, as illustrated in FIG. 7. At this point, the weight of the coiled tubing pumping system 100 is still carried through the support table 204 to the BOP 200.

Figure 8:
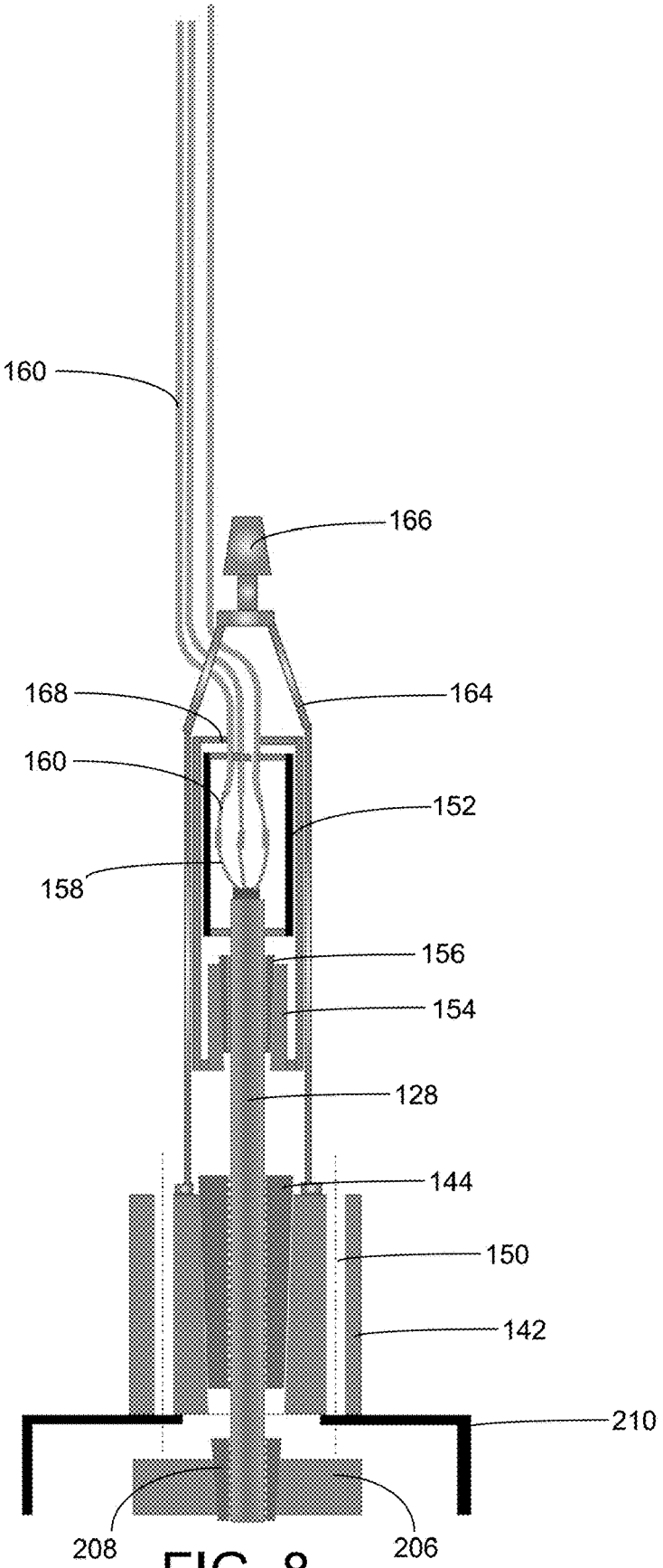
FIG. 8 depicts the installation of the deployment assembly and the completed splice between the coiled tubing and the power cable.

Once the primary slips 144 have been installed, the adapter assembly 138 and lifting assembly 140 can be installed onto the primary hanger 142, as illustrated in FIG. 8. The electrical connections between the power cable leads 158 and the encapsulated surface leads 160 can be made within the connection chamber 152, with the encapsulated surface leads 160 extending out of the deployment assembly 134 through the cable port 168.

Figure 9:
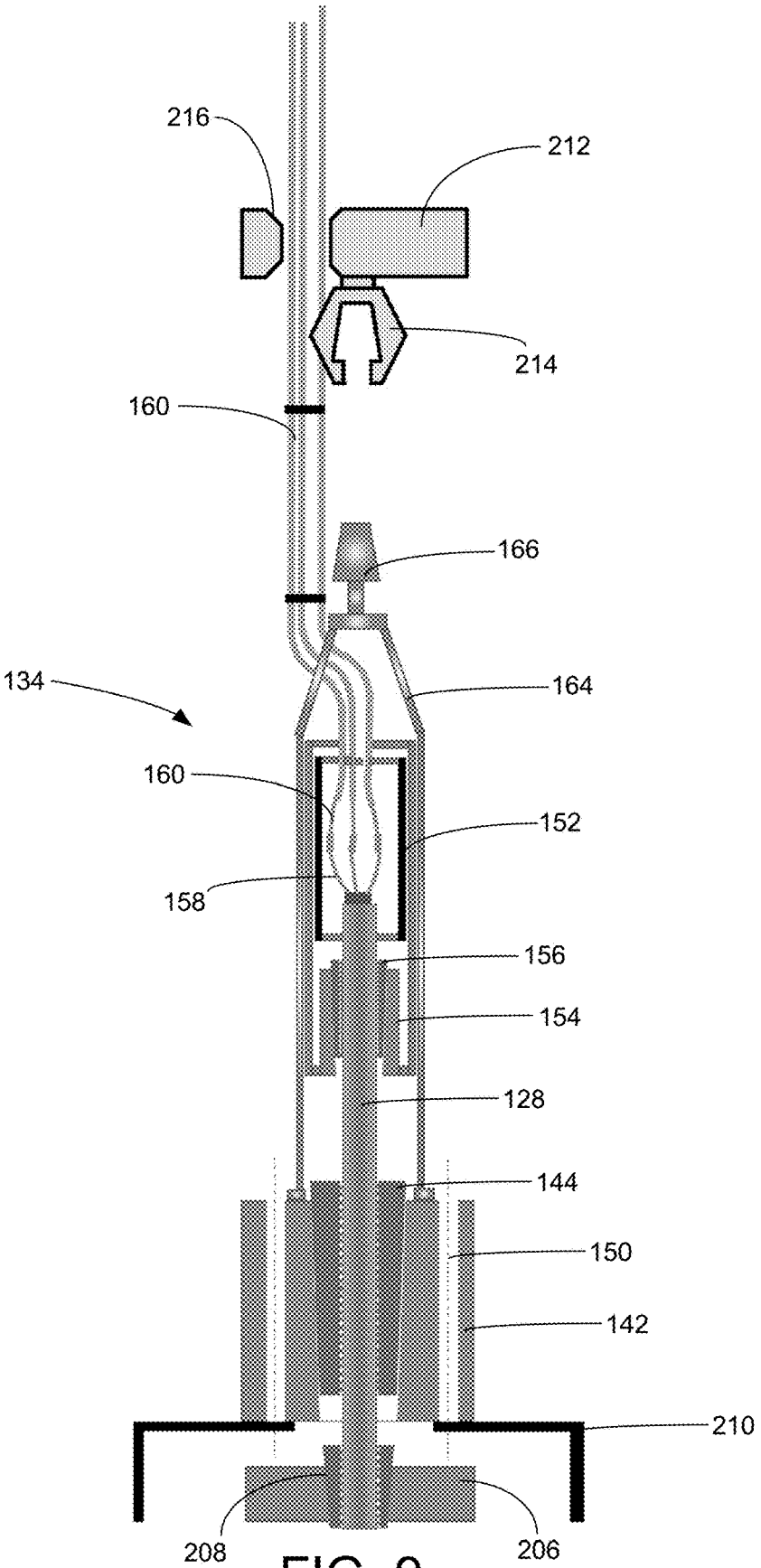
FIG. 9 depicts a step in the installation of the coiled tubing pumping system in which a fishing tool is approaching the deployment assembly.

Once the deployment assembly 134 has been assembled on the deployment assembly table 210 and secured to the coiled tubing 128 and coiled tubing pumping system 100, a lifting mechanism 212 is lowered toward the deployment assembly 134, as depicted in FIG. 9. The lifting mechanism 212 can be a fishing tool that includes a receiver 214 and a cable pass 216. The receiver 214 is configured to securely latch onto the fishing head 166. The cable pass 216 allows the unimpeded passage of the encapsulated surface leads 160.

Figure 10:
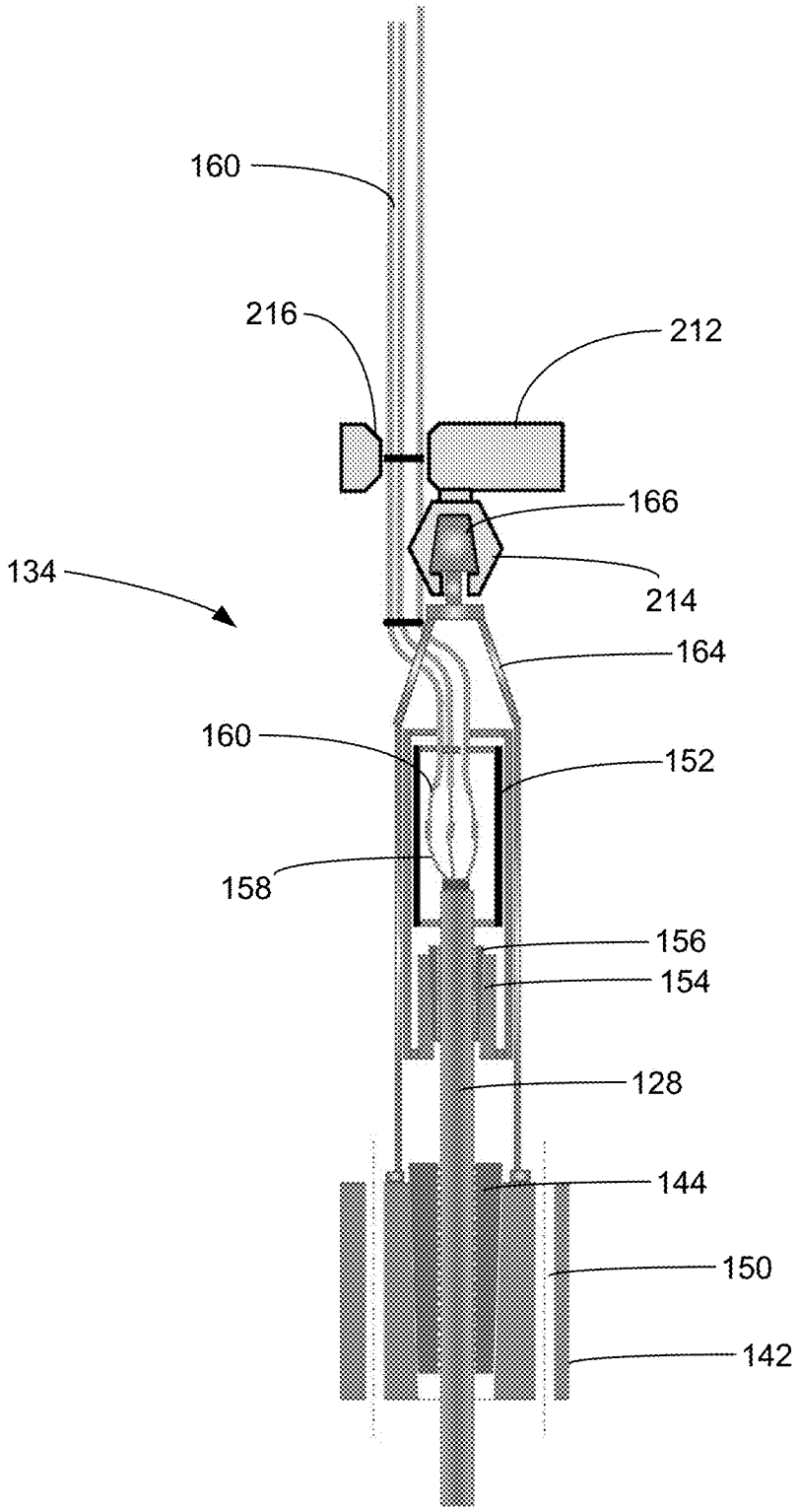
FIG. 10 depicts a step in the installation of the coiled tubing pumping system in which the fishing tool has lifted the coiled tubing pumping system and deployment assembly.
Figure 11:
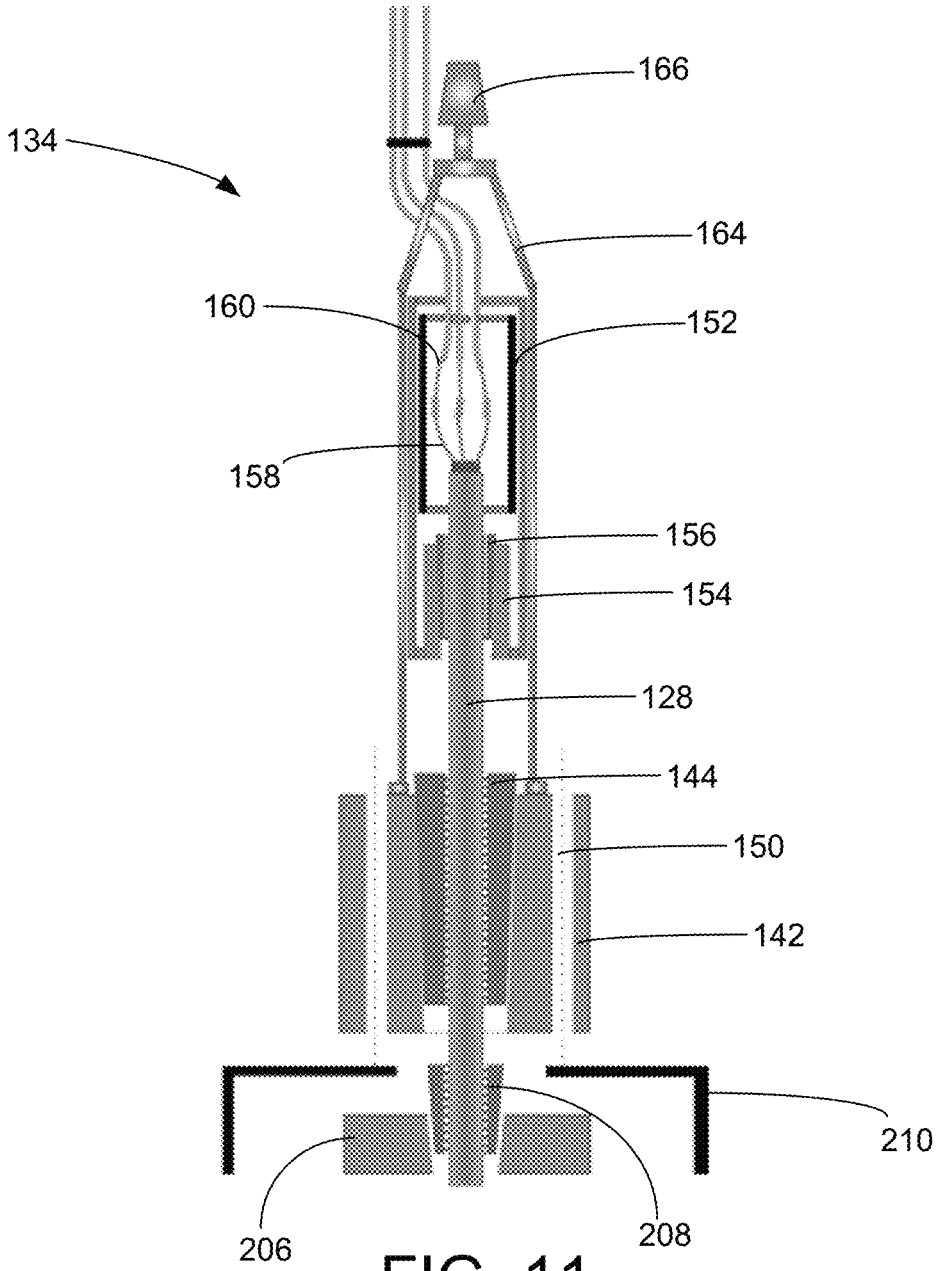
FIG. 11 depicts a step in the installation of the coiled tubing pumping system in which the assembly table and support table are removed.

Once the lifting mechanism 212 is securely attached to the deployment assembly 134, as depicted in FIG. 10, the lifting mechanism 212 can lift the entire coiled tubing pumping system 100, coiled tubing 128, and deployment assembly 134. When the weight of the coiled tubing pumping system 100 is supported by the lifting mechanism 212 through the primary hanger 142 and primary slips 144 rather than the BOP 200, the support table 204, installation hanger 206, installation slips 208, and deployment assembly table 210 can be removed, as illustrated in FIG. 11.

Figure 12:
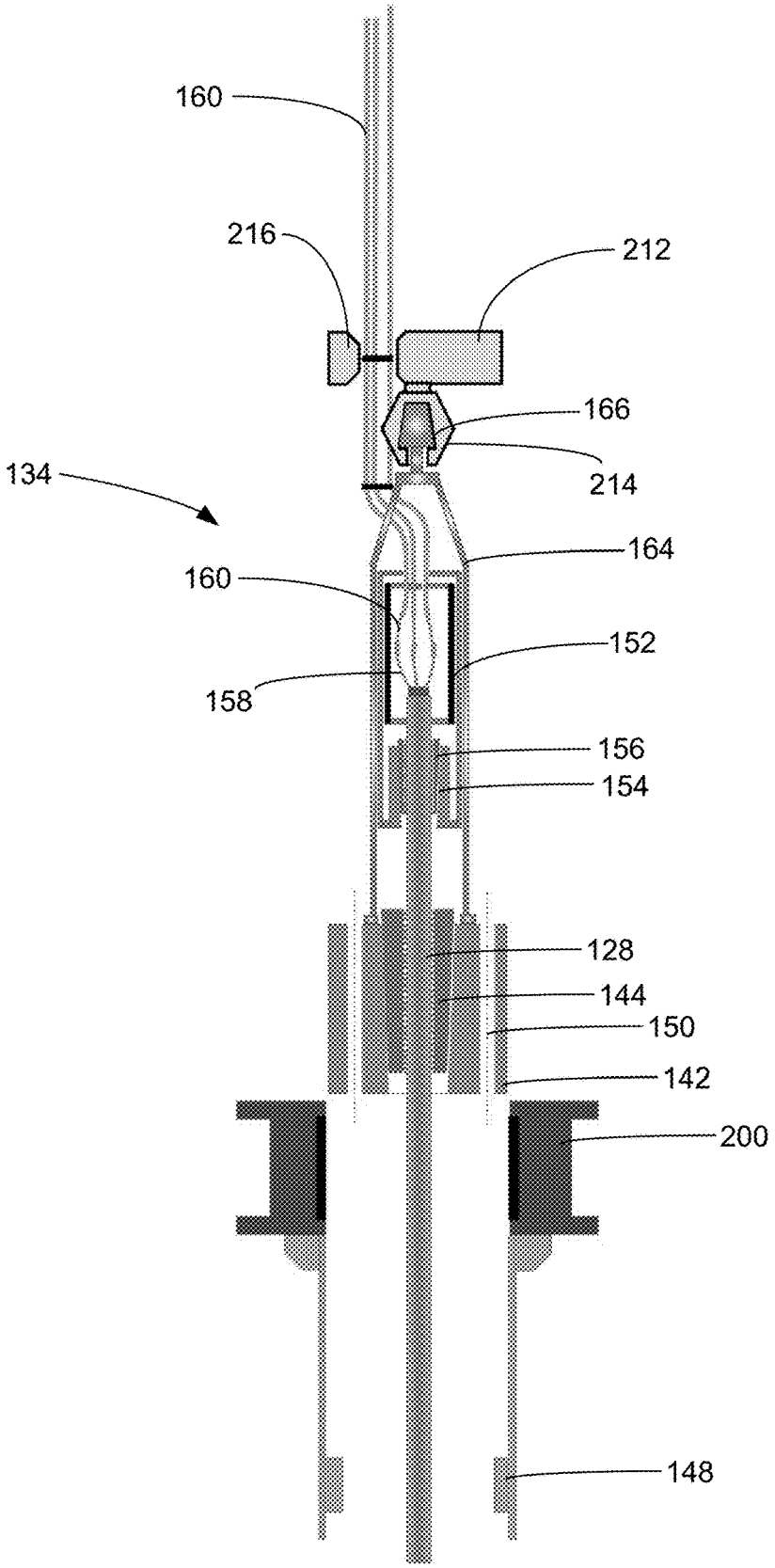
FIG. 12 depicts a step in the installation of the coiled tubing pumping system in which the coiled tubing pumping system and deployment assembly are lowered through the BOP.
Figure 13:
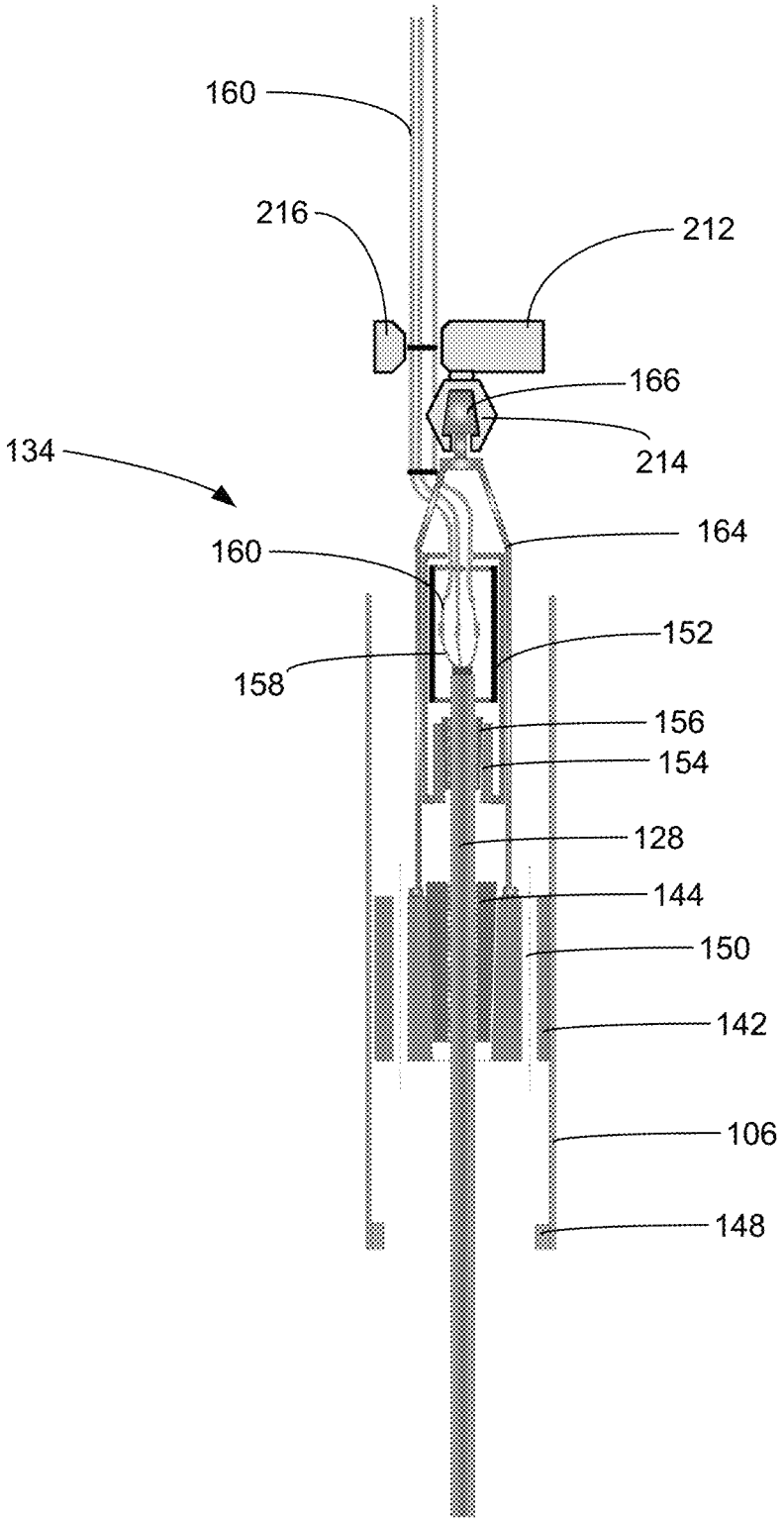
FIG. 13 depicts a step in the installation of the coiled tubing pumping system in which the primary hanger approaches the seating element.

In this way, the deployment assembly table 210, the support table 204, the installation slips 208 and the installation hanger 206 together present a coiled tubing pumping system installation kit 218 that can be temporarily attached to the BOP 200 while the deployment assembly 134 is connected to the coiled tubing 128 and electrical connections are made between the power cable 132 and the encapsulated surface leads 160. Once the installation kit 218 has been removed, the lifting mechanism 212 can be used to lower the coiled tubing pumping system 100, coiled tubing 128 and deployment assembly 134 into the well 102 as depicted in FIGS. 12 and 13.

Figure 14:
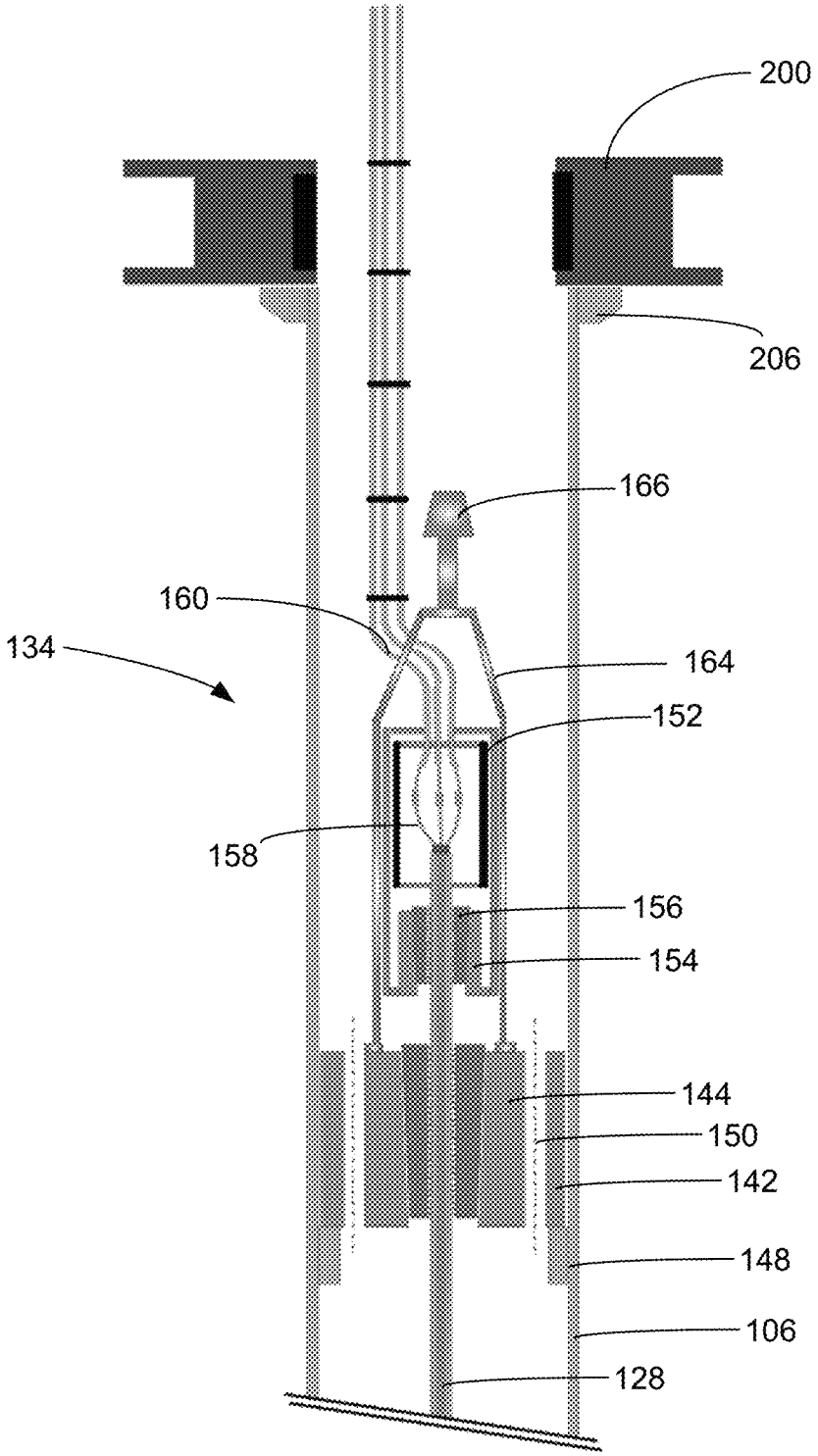
FIG. 14 depicts a step in the installation of the coiled tubing pumping system in which the deployment assembly rests on the tubing nipple and the fishing tool can be released.

When the primary hanger 142 has landed on the seating element 148, as depicted in FIG. 14, the lifting mechanism 212 can be disconnected from the fishing head 166 and lifted out of the well 102. The cable pass 216 ensures that the lifting mechanism 212 does not damage the encapsulated surface leads 160.

Figure 15:
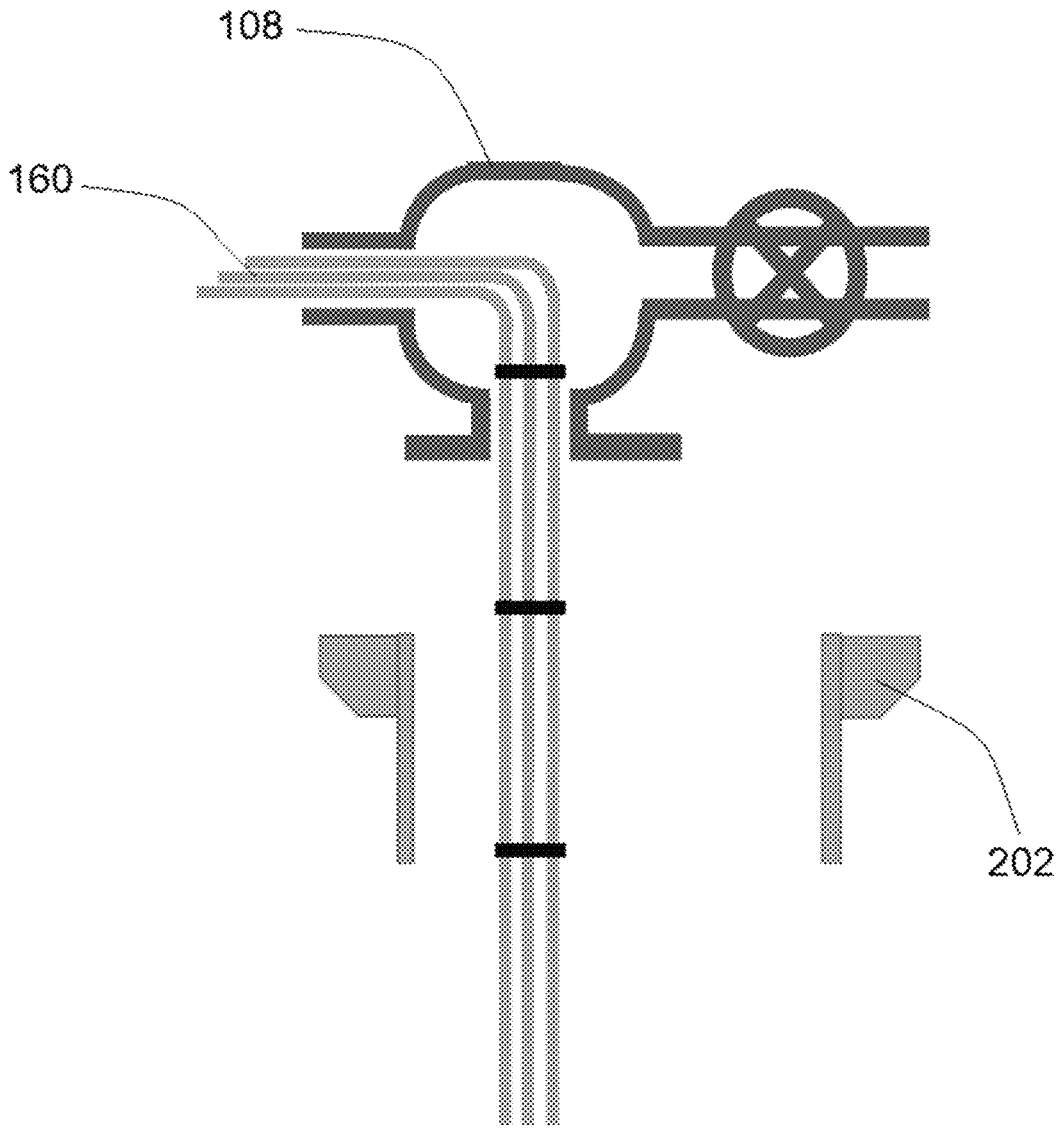
FIG. 15 illustrates the step in the installation of the coiled tubing pumping system in which the wellhead is lifted and the BOP is removed.
Figure 16:
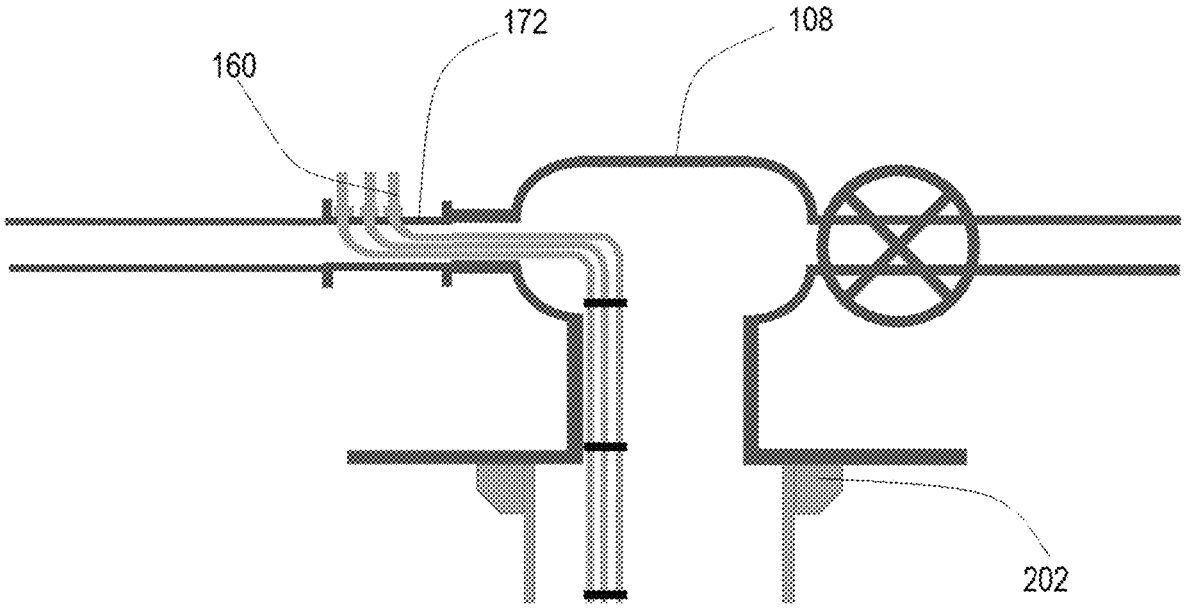
FIG. 16 illustrates the connection of the wellhead to the well and the routing of the electrical cables through the wellhead.

Turning to FIG. 15, shown therein is the next installation step in which the wellhead 108 is lifted above the well 102. The encapsulated surface leads 160 can be routed through the wellhead 108. Once the wellhead 108 is ready to be installed on the well 102, the BOP 200 can be removed. The wellhead 108 can then be lowered onto the well 102, taking care to avoid any impingement of the encapsulated surface leads 160. As illustrated in FIG. 16, the encapsulated surface leads 160 can then be directed through the wellhead 108, for example through the blanked flange 170 or the penetrator 172, and connected to the drive systems and power supply needed to drive the motor 114 of the coiled tubing pumping system 100.

Figure 17:
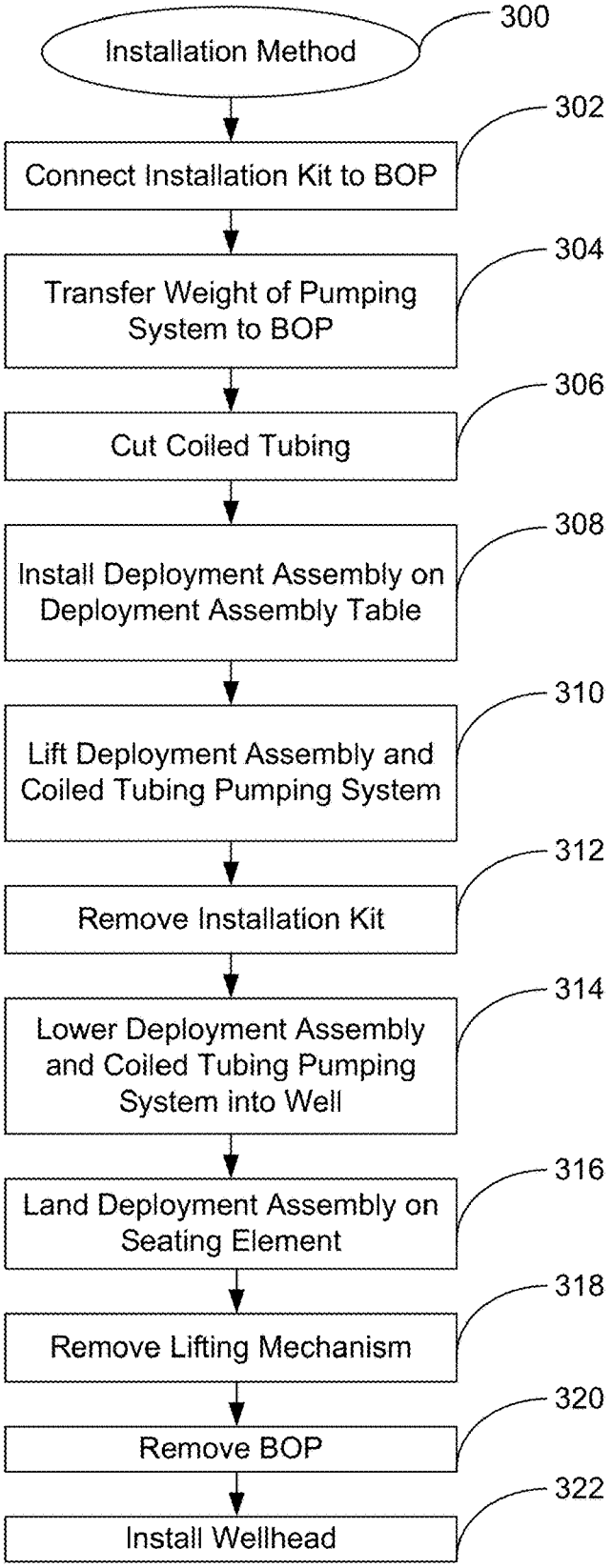
FIG. 17 provides a flow chart for a method of installing the coiled tubing pumping system in a well.

Turning to FIG. 17, shown therein is a process flow chart that depicts an embodiment of an installation method 300 for the deployment of the coiled tubing pumping system 100 into the well 102 with a standard wellhead 108. At step 302, the installation kit 218 is installed onto the BOP 200. At step 304, the weight of the coiled tubing pumping system 100 and coiled tubing 128 are transferred to the support table 204 through the installation hanger 206 and installation slips 208.

At step 306, the coiled tubing 128 is cut and prepared for electrical connection to the encapsulated surface leads 160. Next, at step 308, the deployment assembly 134 is assembled on the deployment assembly table 210. During this step, the electrical connection, e.g., a sliced connection, is made between the power cable leads 158 and the encapsulated surface leads 160 within the connection chamber 152. Once the deployment assembly 134 has been fully assembled and connected to the coiled tubing 128, the lifting mechanism 212 is used to lift the deployment assembly 134, coiled tubing 128 and coiled tubing pumping system 100 at step 310.

At step 312, the installation kit 218 is removed from the BOP to permit the deployment assembly 134 to be lowered into the well 102. At step 316, the deployment assembly 134 is landed on the seating element 148, which transfers the weight of the coiled tubing pumping system 100, the coiled tubing 128 and the deployment assembly 134 to the production tubing 106. Importantly, the weight of the coiled tubing pumping system 100 is carried by the production tubing 106 rather than a modified wellhead.

At step 318, the lifting mechanism 212 is disconnected from the deployment assembly 134 and removed from the well 102. The cable pass 216 of the lifting mechanism 212 prevents damage to the encapsulated surface leads 160 as the lifting mechanism 212 travels out of the well 102. After the lifting mechanism 212 has been extracted from the well 102, the BOP 200 can be removed at step 320. The method is completed at step 322 when the wellhead 108 is secured to the well 102 and the encapsulated surface leads 160 are routed through the wellhead 108 and connected to the motor drive and power supply.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts and steps within the principles of the present invention to the full extent indicated by the broad general meaning of the terms in which the appended claims are expressed. It will be further appreciated that unless otherwise excluded, aspects of one embodiment can be combined or incorporated into other embodiments disclosed herein. It will be appreciated by those skilled in the art that the teachings of the present invention can be applied to other systems without departing from the scope and spirit of the present invention.

What is claimed is:

1. A method for installing a coiled tubing pumping system in a well that includes production tubing and a seating element connected inside the production tubing, the method comprising the steps of:

connecting a continuous length of coiled tubing to the coiled tubing pumping system;

lowering the coiled tubing pumping system and coiled tubing into the production tubing;

temporarily supporting the weight of the coiled tubing pumping system;

cutting the continuous length of coiled tubing to form a coiled tubing segment attached to the coiled tubing pumping system;

attaching a deployment assembly to an upper end of the coiled tubing segment connected to the coiled tubing pumping system, wherein the step of attaching the deployment assembly to the upper end of the coiled tubing segment further comprises the steps of:

placing a primary hanger around the upper end of the coiled tubing segment; and placing primary slips between the primary hanger and the upper end of the coiled tubing segment to connect the coiled tubing segment to the primary hanger; and lowering the deployment assembly, the coiled tubing segment and the coiled tubing pumping system into the well until the primary hanger lands on the seating element.

2. The method of claim 1, further comprising the step of installing a blowout preventer on top of the well before the step of lowering the coiled tubing pumping system into the production tubing.

3. The method of claim 2, wherein the step of lowering the coiled tubing pumping system and coiled tubing into the well comprises lowering the coiled tubing pumping system and coiled tubing through the blowout preventer.

4. The method of claim 2, further comprising the step of placing an installation kit onto the blowout preventer, wherein the installation kit includes a support table connected to the blowout preventer.

5. The method of claim 4, wherein the step of temporarily supporting the weight of the coiled tubing pumping system further comprises temporarily supporting the weight of the coiled tubing pumping system on the support table.

6. The method of claim 5, further comprising the step of assembling the deployment assembly on a deployment assembly table connected to the blowout preventer, wherein the step of assembling the deployment assembly comprises making an electrical connection between encapsulated surface leads and power cable leads from the cut coiled tubing.

7. The method of claim 6, further comprising the step of lifting the deployment assembly, the coiled tubing and the coiled tubing pumping system with a lifting mechanism.

8. The method of claim 7, further comprising the step of removing the installation kit from the blowout preventer.

9. The method of claim 8, further comprising the step of removing the lifting mechanism from the well.

10. The method of claim 9, further comprising the step of removing the blowout preventer.

11. The method of claim 10, further comprising the step of installing a wellhead on the well, wherein the wellhead has not been modified to support the coiled tubing pumping system.

12. The method of claim 11, further comprising the step of providing electrical power to the coiled tubing pumping system through the coiled tubing segment to power the coiled tubing pumping system.

13. The method of claim 1, further comprising the step of providing electrical power to the coiled tubing pumping system through the coiled tubing segment to power the coiled tubing pumping system.

* * * * *